US005605488A

United States Patent [19]

Ohashi et al.

[11] Patent Number: 5,605,488

[45] Date of Patent: Feb. 25, 1997

[54] POLISHING APPARATUS OF SEMICONDUCTOR WAFER

[75] Inventors: Hiroyuki Ohashi, Kamakura; Naoto Miyashita; Ichiro Katakabe, both of Yokohama; Tetsuya Tsukihara, Kitakyushu, all of Japan

[73] Assignee: Kabushiki Kaisha Toshiba, Kawasaki, Japan

[21] Appl. No.: 329,423

[22] Filed: Oct. 27, 1994

[30] Foreign Application Priority Data

Oct. 28, 1993 [JP] Japan ..... 5-270654

[51] Int. Cl.[6] ..... B24B 49/00

[52] U.S. Cl. ..... 451/7; 451/41; 451/53; 451/259; 451/288; 451/388

[58] Field of Search ..... 451/7, 26, 41, 451/53, 488, 290, 289, 288, 285, 388, 402, 385, 449, 6, 8, 9, 505, 24; 269/329

[56] References Cited

U.S. PATENT DOCUMENTS

| | | | |
|---|---|---|---|
| 3,571,978 | 3/1971 | Day | 451/7 |
| 4,270,316 | 6/1981 | Krämer et al. | 451/41 |
| 4,313,284 | 2/1982 | Walsh . | |
| 4,450,652 | 5/1984 | Walsh . | |
| 4,471,579 | 9/1984 | Bovensiepen | 451/259 |
| 4,912,883 | 4/1990 | Chang et al. | 451/1 |
| 4,918,869 | 4/1990 | Kitta | 451/288 |
| 5,036,630 | 8/1991 | Kaanta et al. | 451/41 |
| 5,081,795 | 1/1992 | Tanaka et al. | 451/285 |
| 5,127,196 | 7/1992 | Morimoto et al. | 451/53 |
| 5,203,119 | 4/1993 | Cole | 451/5 |
| 5,398,459 | 3/1995 | Okumura et al. | 451/388 |
| 5,441,444 | 8/1995 | Nakajima | 451/288 |

FOREIGN PATENT DOCUMENTS

| | | | |
|---|---|---|---|
| 2551382 | 3/1985 | France . | |
| 2626208 | 7/1989 | France . | |
| 1109066 | 4/1989 | Japan | 451/288 |
| 1216768 | 8/1989 | Japan | 451/288 |
| 2072550 | 10/1981 | United Kingdom . | |

OTHER PUBLICATIONS

Patent Abstracts of Japan, A. Muraki, *Polishing Method of Mask Reverse Side*, vol. 9, No. 223 (M–411) (1946) Sep. 10, 1985, JP–A–60 080 560.

Patent Abstracts of Japan, R. Hiraga, *Chuck*, vol. 9, No. 311 (M–436) (2034) Dec. 7, 1985, JP–A–60 146 675.

Patent Abstracts of Japan, A. Kiyoshi, *Polishing Apparatus For Wafer*, vol. 14, No. 557 (E–1011) Dec. 11, 1990, JP–A–02 240 925.

*Primary Examiner*—Robert A. Rose
*Assistant Examiner*—George Nguyen
*Attorney, Agent, or Firm*—Finnegan, Henderson, Farabow, Garrett & Dunner, L.L.P.

[57] ABSTRACT

A plurality of cells are provided in a concave portion of a top plate. A cloth to which water is penetrated is provided in a back face of each cell, and a wafer is attracted by the cloth. First and second pipes are connected to each cell. The first pipe introduces liquid to the cell, and the second pipe discharges liquid from the cell, and guides liquid to the first pipe. A constant-temperature device is provided to each first pipe, and a temperature of liquid of each cell is adjusted by the constant-temperature device in accordance with a temperature distribution of the wafer. Whereby, a polishing rate of each part of the wafer can be equalized.

12 Claims, 5 Drawing Sheets

POLISHING APPARATUS OF SEMICONDUCTOR WAFER

BACKGROUND OF THE INVENTION

1. Field of the Invention

The present invention relates to a semiconductor manufacturing device and more particularly to a polishing apparatus for polishing a semiconductor substrate to be flattened.

2. Description of the Related Art

FIG. 10 shows a conventional polishing apparatus. A guide ring 12 is provided around the back face of a top plate 11, and an interlayer material 13 is provided on the back face of the top plate 11, which is positioned at the inside of the guide ring 12. The interlayer material 13 is a cloth to which water penetrates, for example. A semiconductor substrate (wafer) 14 is attracted to the back face of the top plate 11 by the interlayer material 13. As a method for absorbing the wafer 14 to the top plate 11, wax or vacuum chuck can be used. In the case where wax is used, wax is applied on the back surface of the top plate 11, whereby the wafer is attracted to the top plate 11. In the case where vacuum chuck is used, a plurality of intake paths are provided. The wafer, which is attracted to the top plate 11, has a diameter larger than the top plate 11, and is mounted on a polishing plate (not shown) having a polishing cloth is provided on its surface. The polishing plate and the top plate 11 are rotated in a fixed direction, and the wafer is polished by polishing material, which is applied on the polishing cloth.

According to the conventional polishing apparatus, it was difficult to control the temperature of the wafer when polishing. In other words, the temperature of the wafer is increased by friction of the polishing cloth on the wafer and a chemical reaction between the wafer and the polishing material. Due to this, each surface temperature of respective portions of the wafer is not constant. Moreover, a plurality of the wafers are mounted on the polishing plate at one time, and polished simultaneously. However, each temperature of the respective wafers, which are simultaneously polished, was not able to set to be constant. The polishing rate (film thickness/minute: nm/min) depends on the temperature at the time of polishing. Due to this, the polishing rate of each surface of the respective portions of the wafer cannot be equalized. Moreover, the polishing rate of each of the wafers, which are simultaneously polished, and the polishing rate of each batch were not able to be equalized.

SUMMARY OF THE INVENTION

An object of the present invention is to provide a polishing apparatus, which can equalize a polishing rate of each surface of the respective portion of a semiconductor substrate, and which can equalize a polishing rate of each batch.

In order to attain the above object, according to the first aspect of the present invention, there is provided a polishing apparatus comprising a top plate having a container section on its back face; a plurality of cells provided in the container section of the top plate wherein each cell is filled with liquid, and a semiconductor substrate to be polished is attracted to each cell; a pipe for introducing liquid to each cell; and heating means, provided in the pipe, for heating liquid, wherein the heating means heat liquid of each cell in accordance with a temperature distribution of the semiconductor substrate.

Further, in order to attain the above object, according to the second aspect of the present invention, there is provided a polishing apparatus comprising a top plate having a container section on its back face; a plurality of flexible cells provided in the container section of the top plate wherein each cell is filled with liquid, and a semiconductor substrate to be polished is attracted to each cell; a pipe for introducing liquid to each cell; and adjusting means, provided in the pipe, for adjusting liquid in accordance with a warp of the semiconductor substrate.

BRIEF DESCRIPTION OF THE DRAWINGS

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE PREFERRED EMBODIMENTS

Embodiments of the present invention will be explained with reference to the drawings.

Figure 1:
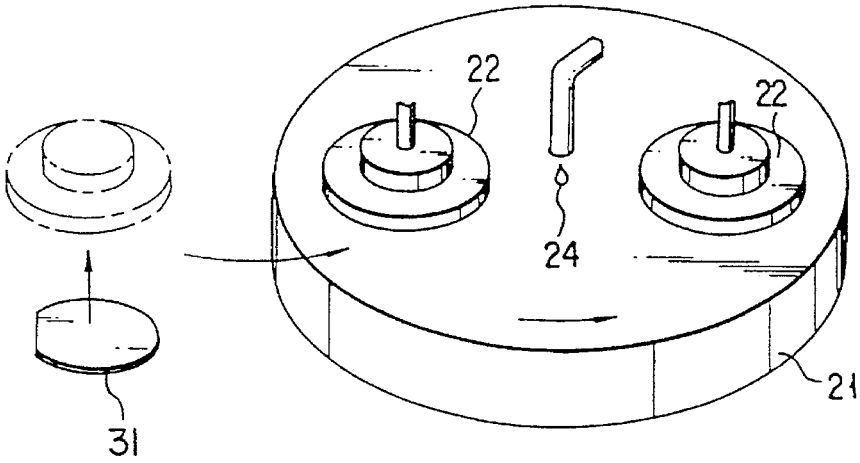
FIG. 1 is a perspective view schematically showing a polishing apparatus.

In FIG. 1, a polishing cloth (not shown) is provided on the surface of a polishing plate 21, and a plurality of top plates 22 are mounted on the polishing cloth. The top plate 22 is movable from the surface of the polishing plate 21 as shown in a broken line. A semiconductor substrate (hereinafter called as a wafer) 31 is attracted by the top plate 22 or detached from the top plate 22 at a position shown by the broken line. The polishing plate 21 is rotated in a fixed direction, and the wafer, which is attracted by the top plate 22, is polished by a friction of the polishing cloth and a chemical reaction with polishing material 24 applied onto the polishing cloth.

Figure 2:
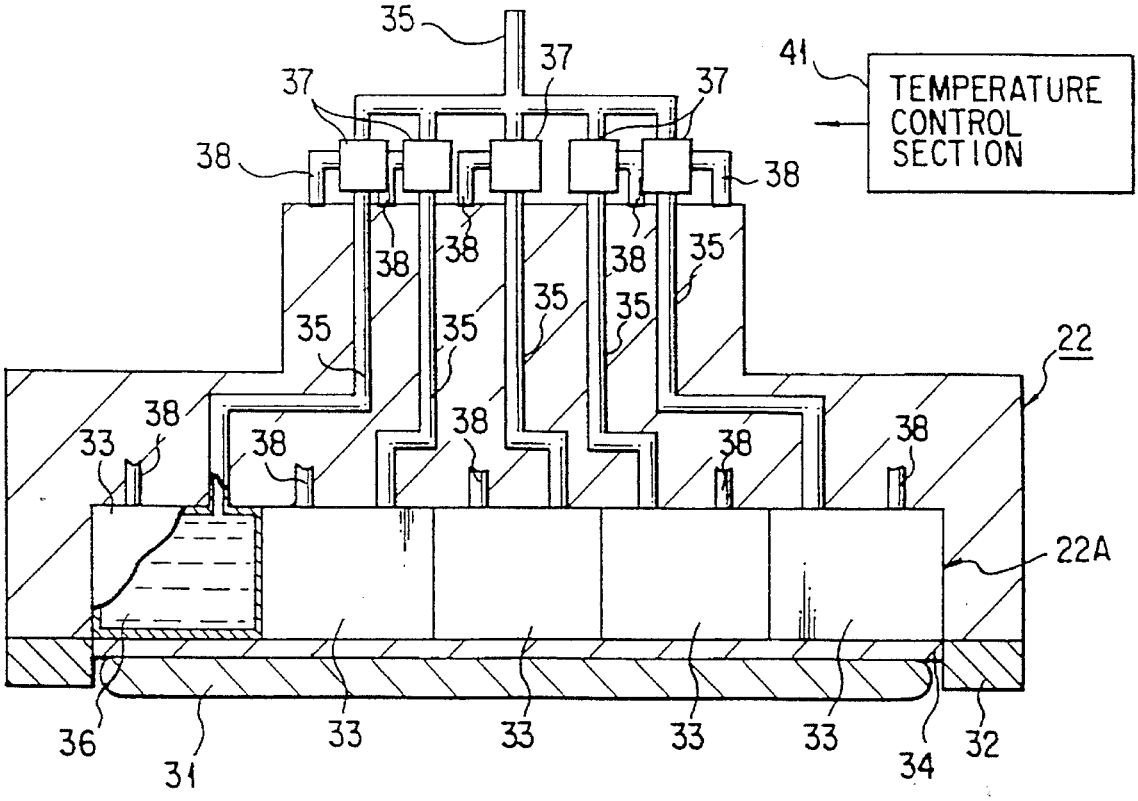
FIG. 2 is a cross sectional view schematically showing a polishing apparatus of a first embodiment of the present invention.

FIG. 2 shows a first embodiment of the present invention. A circular concave portion 22A, for example, is formed on the back face of the top plate 22. A guide ring 32 for positioning a wafer 31 is provided around the concave portion 22A. A plurality of cells 33 are provided in the concave portion 22A. These cells 33 are formed of nylon having heat resistance or vinyl chloride, rubber. The position of the bottom surface of each cell 33 is substantially conformed to that of the back face of the top plate 22. An interlayer material 34 is provided on the bottom surface of each cell 33, which is positioned at the inside of the guide ring 32. The interlayer material 34 is a cloth to which water, for example, is penetrated, and the wafer 31 is attracted by the interlayer material 34.

On the other hand, a plurality of first pipes 35 are connected to each other at their one ends, and other ends are communicated with the cells 33, respectively. Each of the first pipes 35 is used to introduce liquid, for example, water to each cell 33, and a constant-temperature device 37 is provided at an intermediate section of each first pipe 35. Further, one end of each of a second pipe 38 is connected to each of the first pipe 35, and other end of each of the second pipe 38 is communicated with each of the cells 33. Each of the second pipe 38 is used to discharge liquid 36 from the cell 33, and introduce liquid to the first pipe 35.

Figure 3:
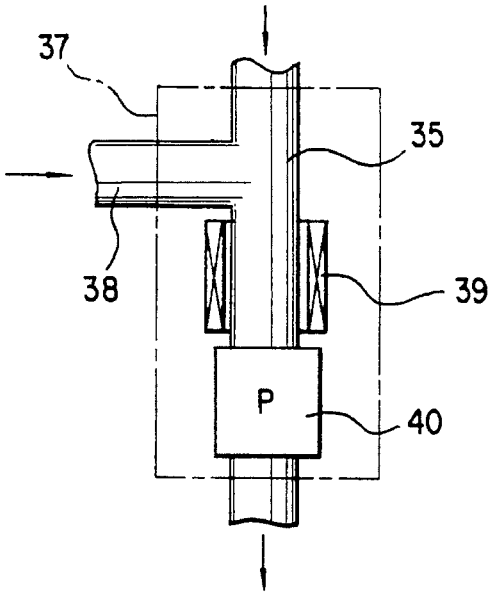
FIG. 3 is a structural view showing part of FIG. 2.

FIG. 3 shows the constant-temperature device 37. A heater 39 is provided around the first pipe 35, which is positioned at a lower portion than a connecting section between the first and second pipes 35 and 38, and liquid 36, which flows into the first pipe 35, is heated by the heater 39. A pump (P) 40 is provided at a lower portion than the heater 39 of the first pipe 35. Liquid 38, which is heated by the heater 39, is circulated through the first pipe 35, the cell 33, and the second pipe 38 in order by the pump 40. Moreover, as shown in FIG. 2, a temperature control section 41 is connected to each constant-temperature device 37. The temperature control section 41 controls the heater 39 of each constant-temperature device 37, individually. Therefore, liquid 36 of each cell 33 is controlled to an arbitrary temperature.

In a case where the wafer is polished by the above-structured top plate 22, the wafer 31 is attracted by the interlayer material 34 of the top plate 22. Liquid 36, which is temperature-controlled by the constant-temperature device 37, is supplied to each cell 33, and the wafer 31 is heated by liquid 36 of each cell 33. Under this state, as shown in FIG. 1, the wafer 31 is mounted on the polishing plate, and polished by the function of the polishing cloth and that of the polishing material. In this case, the temperature distribution of the wafer 31 is changed by the friction of the polishing cloth and the chemical reaction of the polishing material. As mentioned above, the polishing rate depends on the temperature. Therefore, regarding a portion where the temperature of the wafer 31 is low and the polishing rate is low, the temperature of liquid 36 of the cell 33 corresponding to the above portion is increased by the constant-temperature device 37, whereby the polishing rate can be increased. In other words, for example, the distribution of the polishing rate of the wafer is measured in advance, and the temperature of liquid 36 of the cell 33, which corresponds to the portion where the polishing rate is low, is increased by the constant-temperature device 37, whereby the polishing rate of each portion of the wafer can be equalized.

Figure 4:
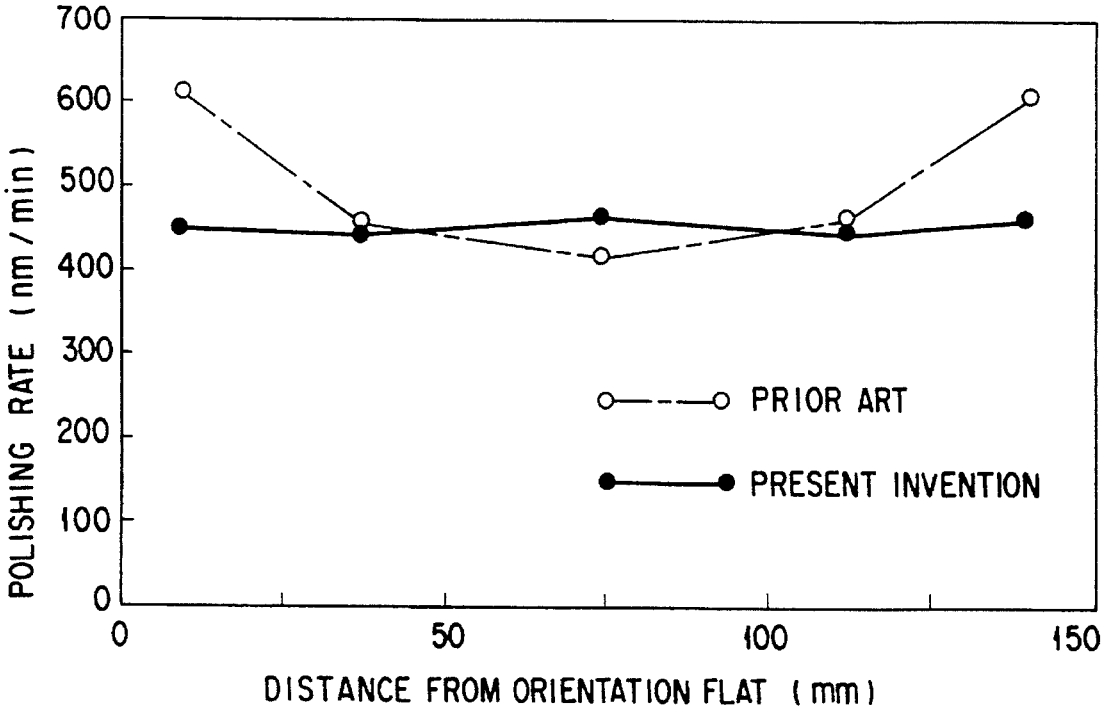
FIG. 4 is a characteristic view showing the polishing rate of the present invention and that of the conventional device.

FIG. 4 shows the polishing rate in the case where the device of the first embodiment is used and the polishing rate in the case where the conventional device is used. As is obvious from the figure, in the case of the conventional device, the polishing rate of the peripheral portion of the wafer and that of the central portion are largely different. However, in the case where the device of the present invention is used, the polishing rate of the peripheral portion of the wafer and that of the central portion can be equalized.

According to the first embodiment, the plurality of the cells 33 are provided on the top plate 22, and the temperature of liquid 36 of each cell 33 is controlled, whereby the temperature distribution of the wafer can be adjusted. Therefore, the polishing rate of each part of the wafer can be equalized, and the polishing rate of each batch can be equalized.

Figure 5:
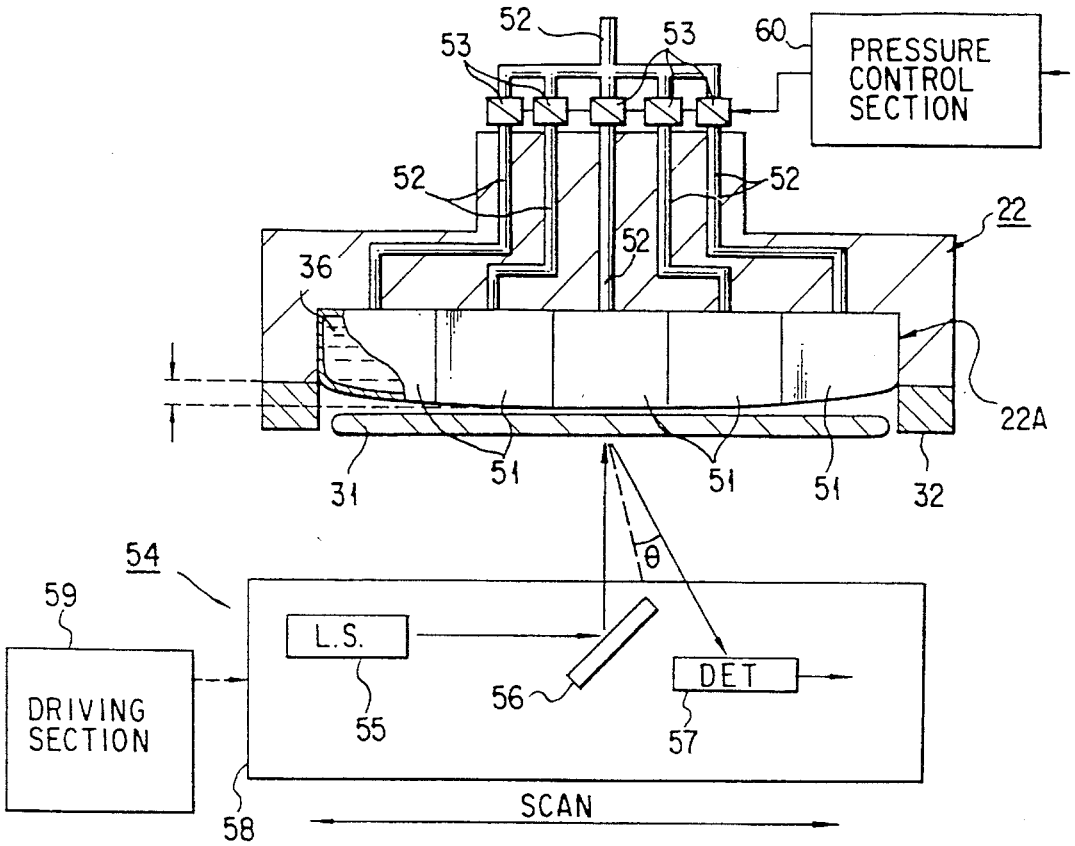
FIG. 5 is a cross sectional view schematically showing a polishing apparatus of a second embodiment of the present invention.

FIG. 5 shows a second embodiment of the present invention, and the same reference numerals as the first embodiment are used for the same portions is the second embodiment.

In FIG. 5, a plurality of cells 51 are provided in the concave portion 22A of the top plate 22. These cells 51 are formed of flexible material such as nylon or rubber. The position of the bottom surface (chucking surface) of each cell 51 is substantially conformed to that of the back face of the top plate 22. Wax (not shown), for example, is applied onto the bottom surface of each cell 51, which is positioned at the inside of the guide ring 32, and the wafer 31 is attracted to the bottom face of each cell 51 through wax. The attracting method of the wafer 31 is not limited to wax, and interlayer material having a cloth to which water is penetrated and a vacuum chuck can be used. In the case where the interlayer material is used, it is needed that material, which can transfer the position and the pressure of the chucking surface of each cell 51 to the wafer 31, be selected as described later. In the case where the vacuum chuck is used, the intake path is provided between the respective cells 51.

On the other hand, a plurality of first pipes 52 are connected to each other at their one ends, and other ends are communicated with the cells 51, respectively. Each of the first pipes 51 is used to introduce liquid 36, for example, water to each cell 51. A valve 53 is provided at an intermediate portion of each pipe 52 so as to control pressure of each cell 51. By the function of the valve 53, pressure to be added to the semiconductor wafer 31 from the cell 51 is changed.

At the lower portion of the top plate 22, there is provided a measuring section 54 for measuring a warp of the wafer 31. The measuring section 54 is provided between the polishing plate 21 shown in FIG. 1 and a top plate shown by a broken line. The measuring section 54 comprises, for example, a housing 58, a light source (L.S) 55, which is provided in the housing 58, for emitting a laser beam, a mirror 56, a detector 57, formed of, for example, a CCD line sensor, for detecting light, and a driving section 59, which moves the housing 58 along the wafer 31, and scans the wafer 31.

The polishing surface of the wafer 31 is irradiated with the laser beam emitted from the light source 55 by the mirror 56. The laser beam reflected on the wafer 31 is made incident onto the detector 57. An angle θ of reflection of the laser beam due to the wafer 31 changes in accordance with the warp of the wafer 31, and the position of the laser beam incident onto the detector 57 changes in accordance with the angle θ of reflection. Therefore, the warp of each part of the wafer 31 can be detected from the incident position of the laser beam onto the detector 57. An output signal of the detector 57 is supplied to a pressure control section 60. The pressure control section 60 controls each valve 53 in accordance with the output signal of the detector 57, and adjusts pressure of each cell 51 in accordance with the warp of the wafer 31. Therefore, the position of the chucking surface of each cell 51 can be adjusted in accordance with the warp of the wafer 31.

Figure 6:
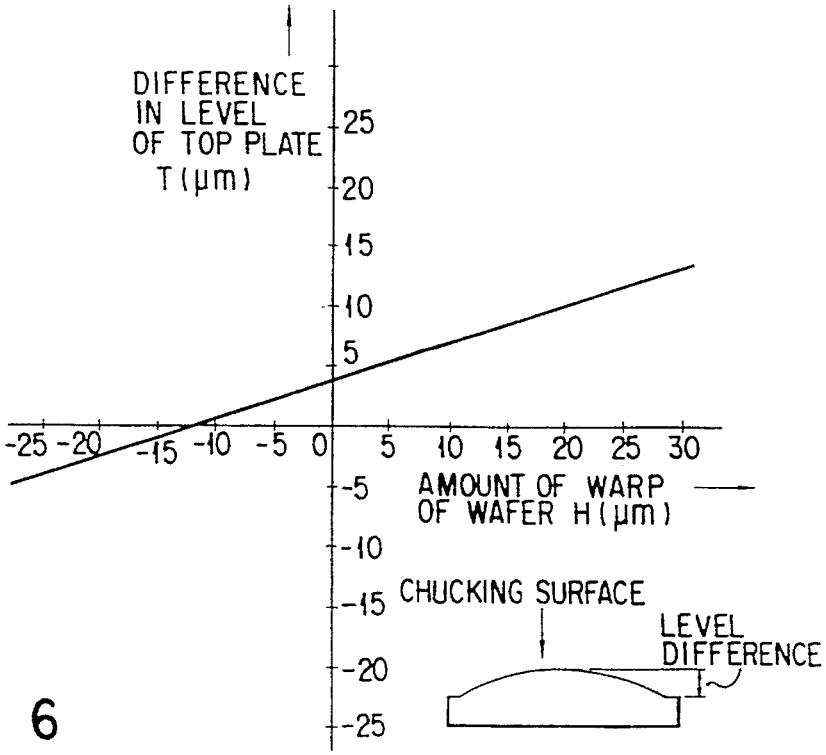
FIG. 6 is a characteristic view showing an operation of FIG. 5.

FIG. 6 is a characteristic view showing the relationship an amount of warp H of the wafer 31 and a level difference T of the chucking surface of each cell 51. The pressure control section 60 controls the position of the chucking surface of each cell 51 in accordance with the detected amount of the warp based on the characteristic view. In this way, by polishing in a state that the warp of the wafer is corrected, the variation of the polishing rate of each part of the wafer can be controlled, and the polishing rate of each batch can be equalized.

Figure 7:
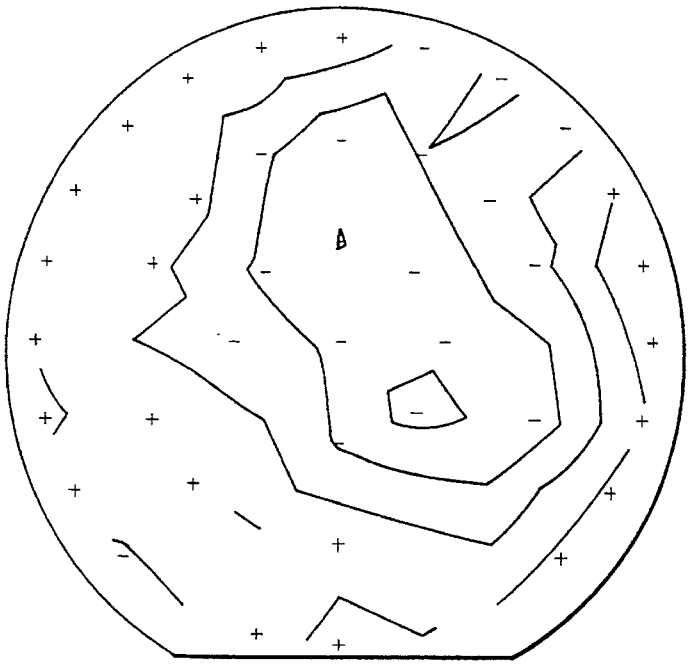
FIG. 7 is a view showing a distribution of an amount of polishing in a case where a wafer is polished by the device of FIG. 5.
Figure 8:
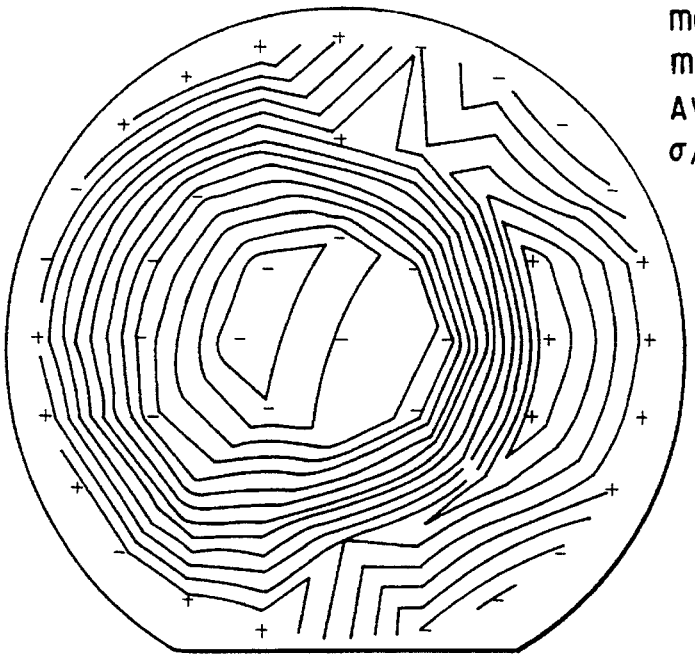
FIG. 8 (PRIOR ART)
FIG. 8 is a view showing a distribution of an amount of polishing in a case where a wafer is polished by a conventional device.

FIGS. 7 and 8 show a map of the amount of polishing of each wafer. FIG. 7 shows a case in which polysilicon of the wafer is polished by the device of the second embodiment, and FIG. 8 shows a case in which polysilicon of the wafer is polished by the conventional device. In the case in which polysilicon of the wafer is polished by the conventional device of, the variation of the inner surface of the polishing rate was about 16%. In the case in which polysilicon of the wafer is polished by the device of the second embodiment, the variation of the surface of the polishing rate was able to reduce to about 3%. Moreover, in the case in which polysilicon of the wafer is polished by the device of the second embodiment, the variation of the polishing rate between the respective wafers was able to reduced to about 3 to 5%.

Figure 9:
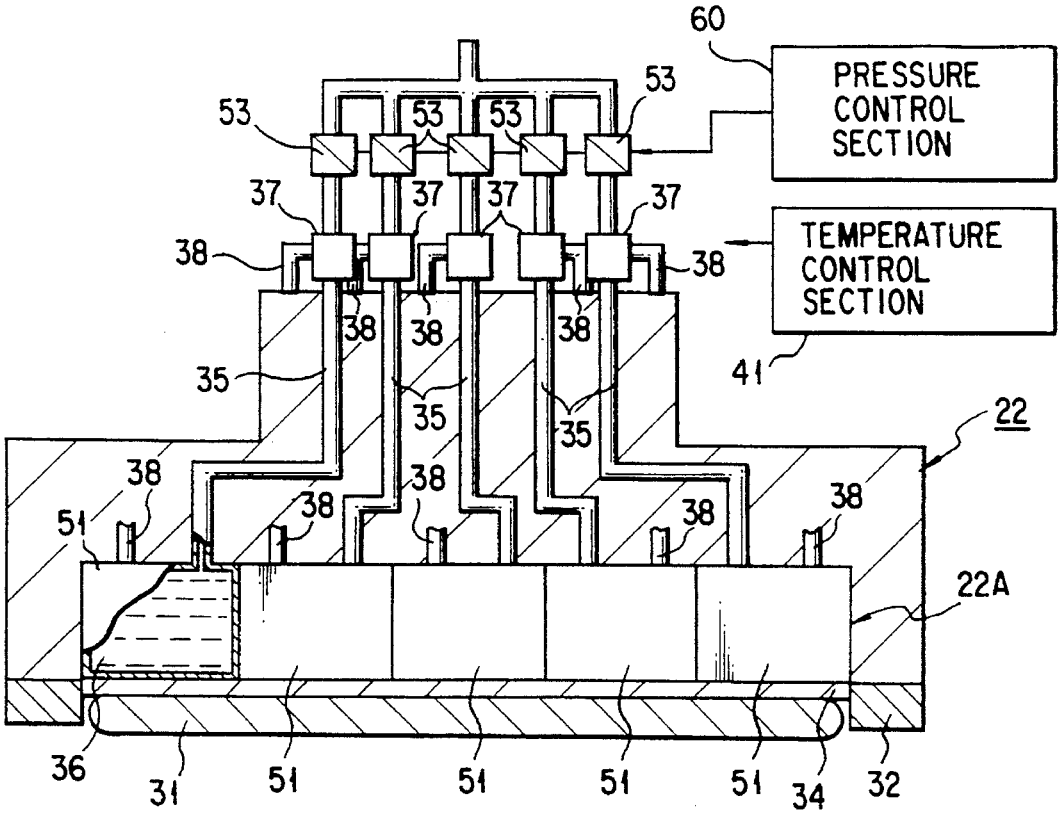
FIG. 9 is a cross sectional view schematically showing a polishing apparatus of a third embodiment of the present invention.
Figure 10:
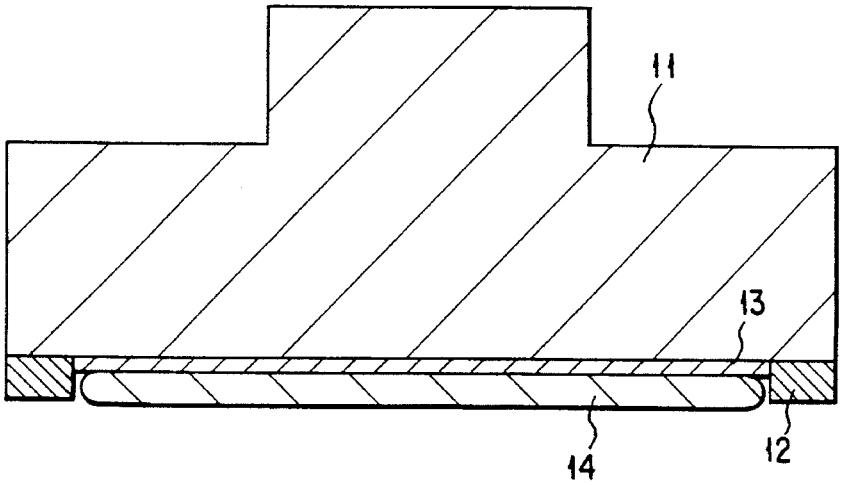
F I G. 10 ( PRIOR ART )
FIG. 10 is a a cross sectional view schematically showing a conventional polishing apparatus.

FIG. 9 shows a third embodiment of the present invention in which the first and second embodiment are combined, and the same reference numerals as the first and second embodiments are added to the same portions as the first and second embodiments. FIG. 9 shows only the top plate, and the measuring section of FIG. 5 is omitted. The valve 53, and the constant-temperature device 37 are provided in the first pipe 35. Each valve 53 is controlled by the pressure control section 60, and each constant-temperature device 37 is controlled by the temperature control section 41. The first pipe 35 and the second pipe 38 are connected to each cell 51. Liquid 36 of each cell 51 is heated by the constant-temperature device 37 in a state that a predetermined pressure is applied by the valve 53. Then, liquid 36 is circulated in the first pipe 35, the cell 51, and the second pipe 38.

According to the third embodiment, the temperature of liquid 36 of each cell 51 and the pressure are controlled in accordance with the temperature of each part of the wafer, and the amount of the warp. Therefore, the polishing rate can be adjusted in accordance with the temperature of each part of the wafer, and the amount of the warp, the polishing rate of the inner surface of the wafer can be further equalized.

What is claimed is:

1. A polishing apparatus comprising:

a top plate having a concave portion on its back face;

a plurality of cells provided in the concave portion of said top plate, each of said cells being filled with liquid and retaining a portion of a semiconductor substrate to be polished;

a plurality of pipes for introducing said liquid to each of said cells, respectively; and adjusting means, provided in each of said pipes, for adjusting temperature of said liquid in each of said cells to compensate for polishing rate variations of the respective portions of said semiconductor substrate.

2. A polishing apparatus comprising:

a top plate having a concave portion on its back face;

a plurality of cells provided in the concave portion of said top plate, each of said cells being filled with liquid and retaining a portion of a semiconductor substrate to be polished;

a plurality of first pipes for introducing said liquid to each of said cells, respectively;

a plurality of second pipes, each having one end connected to one of said cells and another end connected to a corresponding one of said first pipes for discharging said liquid from said one cell, and introducing said liquid to the corresponding one of the first pipes;

a plurality of heaters, one such heater being provided around each of said first pipes; and a controller connected to said heaters for adjusting temperature of said heaters, respectively, whereby said controller adjusts the temperature of liquid of each cell by adjusting the temperature of each heater to compensate for polishing rate variations of the respective portions of said semiconductor substrate.

3. The apparatus according to claim 2, further comprising;

a plurality of pumps, one such pump being provided in each of said first pipes, for moving liquid in said first pipes.

4. A polishing apparatus comprising:

a top plate having a concave portion on its back face;

a plurality of flexible cells provided in the concave portion of said top plate, each of said cells being filled with liquid and having a surface retaining a portion of a semiconductor substrate to be polished;

a plurality of pipes for introducing said liquid to each of said cells, respectively; and a plurality of adjusting means, one such adjusting means being provided in each of said pipes, for adjusting pressure of said liquid in each of said cells, thereby to adjust position of the surface of each cell retaining a portion of the semiconductor substrate in accordance with an amount of warp of said semiconductor substrate.

5. A polishing apparatus comprising:

a top plate having a concave portion on its back face;

a plurality of flexible cells provided in the concave portion of said top plate, each of said cells being filled with liquid and having a surface retaining a portion of a semiconductor substrate to be polished;

a pipe for introducing said liquid to each of said cells;

measuring means for irradiating said semiconductor substrate with light, and measuring an amount of a warp of said semiconductor substrate in accordance with an angle of light reflected from said semiconductor substrate; and adjusting means, provided in said pipe, for adjusting pressure of said liquid, to adjust position of the surface of said cell retaining a portion of the semiconductor substrate in accordance with an amount of the warp of said semiconductor substrate.

6. The apparatus according to claim 5, wherein said measuring means comprises:

a housing;

driving means for driving said housing along said semiconductor substrate;

a light source, provided in said housing, for generating a laser beam;

means for guiding the laser beam generated by said light source to said semiconductor substrate;

detecting means for detecting the laser beam reflected on said semiconductor substrate, wherein said detecting means detects the amount of the warp of the semiconductor substrate by the detected angle of reflection of the laser beam; and controlling means for controlling said adjusting means in accordance with the amount of the warp of said semiconductor substrate detected by said detecting means.

7. The apparatus according to claim 6, wherein said adjusting means comprises a valve.

8. A polishing apparatus comprising:

a top plate having a concave portion on its back face;

a plurality of flexible cells provided in the concave portion of said top plate, each of said cells being filled with liquid and having a surface retaining a portion of a semiconductor substrate to be polished;

a first pipe for introducing said liquid to each of said cells;

a second pipe having one end connected to each of said cells and other end connected to said first pipe for discharging said liquid from said cell, and introducing said liquid to the first pipe;

heating means, provided in said first pipe, for heating the liquid of each cell to compensate for polishing rate variations of the respective portions of said semiconductor substrate;

measuring means for irradiating said semiconductor substrate with light, and measuring an amount of a warp of said semiconductor substrate in accordance with an angle of light reflected on said semiconductor substrate; and adjusting means, provided in said first pipe, for adjusting pressure of said liquid to adjust position of the surface of said cell retaining a portion of the semiconductor substrate in accordance with an amount of the warp of said semiconductor substrate.

9. The apparatus according to claim 8, wherein said measuring means comprising:

a housing;

driving means for driving said housing along said semiconductor substrate;

a light source, provided in said housing, for generating a laser beam;

means for guiding the laser beam generated by said light source to said semiconductor substrate;

detecting means for detecting the laser beam reflected on said semiconductor substrate, wherein said detecting means detects the amount of the warp of the semiconductor substrate by the detected angle of reflection of the laser beam; and controlling means for controlling said adjusting means in accordance with the amount of the warp of said semiconductor substrate detected by said detecting means.

10. The apparatus according to claim 9, wherein said adjusting means comprises a valve.

11. A polishing apparatus comprising:

a polishing plate wherein said polishing plate is rotated and polishing material is applied on a surface of the polishing plate;

a top plate mounted on a surface of said polishing plate, and having a concave portion on its back face;

a plurality of cells provided in the concave portion of said top plate, each of said cells being filled with liquid and retaining a portion of a semiconductor substrate, said semiconductor substrate being brought into contact with the surface of said polishing plate and polished;

a plurality of first pipes for introducing said liquid to each of said cells, respectively;

a plurality of second pipes, each having one end connected to one of said cells and another end connected to a corresponding one of said first pipes for discharging said liquid from said one cell, and introducing said liquid to the corresponding one of the first pipes; and a plurality of heating means, one such heating means being provided in each of said first pipes for heating said liquid of each cell to compensate for polishing rate variations of the respective portions of said semiconductor substrate.

12. The apparatus according to claim 11, wherein each said heating means comprises:

a heater, provided around said first pipe, for heating liquid of said first pipe; and a pump, provided in said first pipe, for moving liquid of said first pipe.

* * * * *

UNITED STATES PATENT AND TRADEMARK OFFICE

CERTIFICATE OF CORRECTION

PATENT NO. : 5,605,488

DATED : February 25, 1997

INVENTOR(S) : Hiroyuki OHASHI et al.

It is certified that error appears in the above-indentified patent and that said Letters Patent is hereby corrected as shown below:

Claim 5, column 6, line 46, after "liquid" delete --,--.

Signed and Sealed this

Twenty-first Day of April, 1998

Bruce Lehman

*Attest:*

BRUCE LEHMAN

*Attesting Officer*

*Commissioner of Patents and Trademarks*